United States Patent [19]

DeYoe

[11] Patent Number: 4,693,691

[45] Date of Patent: Sep. 15, 1987

[54] FLOAT MATTRESS

[75] Inventor: Jay DeYoe, Gold Hill, Oreg.

[73] Assignee: HIS, Inc., Medford, Oreg.

[21] Appl. No.: 759,407

[22] Filed: Jul. 26, 1985

[51] Int. Cl.[4] ..... B63C 9/10

[52] U.S. Cl. ..... 441/129; 272/1 B; D12/316

[58] Field of Search ..... 441/35, 125, 126, 127, 441/128, 129, 130, 42; 272/1 B; D12/316

[56] References Cited

U.S. PATENT DOCUMENTS

| | | | |
|---|---|---|---|
| 1,134,602 | 4/1915 | Frye | 441/128 |
| 1,960,474 | 5/1934 | Browne | 441/129 |
| 2,492,699 | 12/1949 | Houwink . | |
| 2,724,133 | 11/1955 | Sorrell . | |
| 2,803,023 | 8/1957 | Rosenberg et al. . | |
| 3,369,262 | 2/1968 | Judd . | |
| 3,380,088 | 4/1968 | d'Adesky . | |
| 3,860,976 | 1/1975 | Suyama | 272/1 B |
| 4,275,473 | 6/1981 | Poirier . | |
| 4,484,781 | 11/1984 | Phelps | 272/1 B |

FOREIGN PATENT DOCUMENTS

| | | | |
|---|---|---|---|
| 405564 | 7/1910 | France | 441/111 |

*Primary Examiner*—Joseph F. Peters, Jr.
*Assistant Examiner*—Thomas J. Braham
*Attorney, Agent, or Firm*—Klarquist, Sparkman, Campbell, Leigh & Whinston

[57] ABSTRACT

A float mattress having a center of gravity low relative to its center of buoyancy is disclosed. The mattress comprises a bag formed of meshed fabric and granular, buoyant material contained within the bag. In a body of water, the mattress is stabilized by water passing freely through the bag to displace air within. The meshed fabric has openings smaller in size than the size of the granules of the material to contain the granules while allowing the water and air to pass therethrough. The mattress may also include a storage pouch accessibly mounted therein and a removable pillow of similar construction to the mattress.

7 Claims, 5 Drawing Figures

FIG. 2
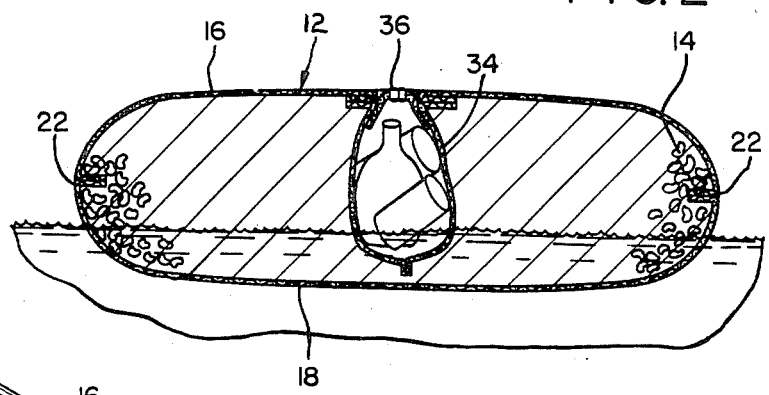
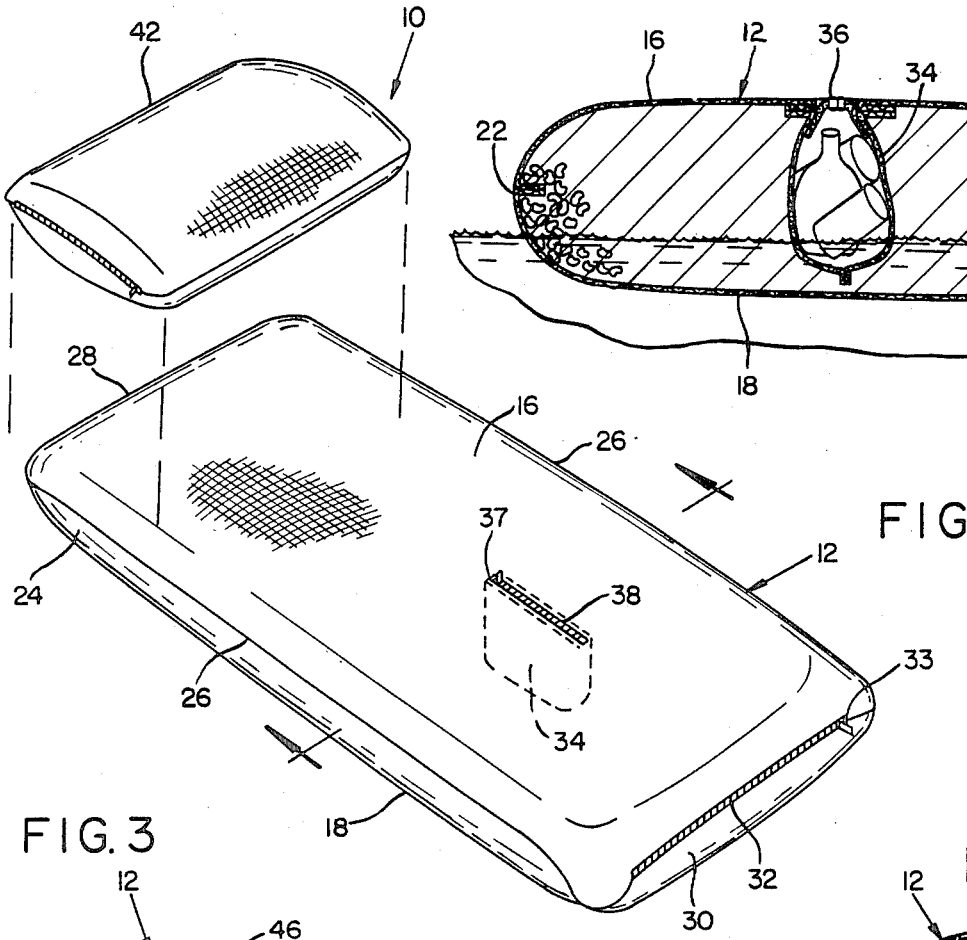
FIG. 1
FIG. 3
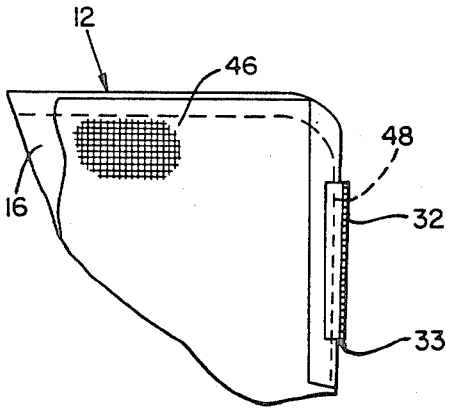
FIG. 5
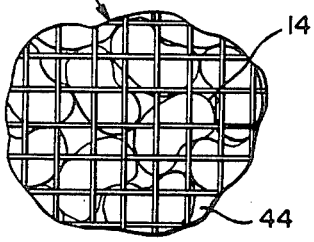
FIG. 4
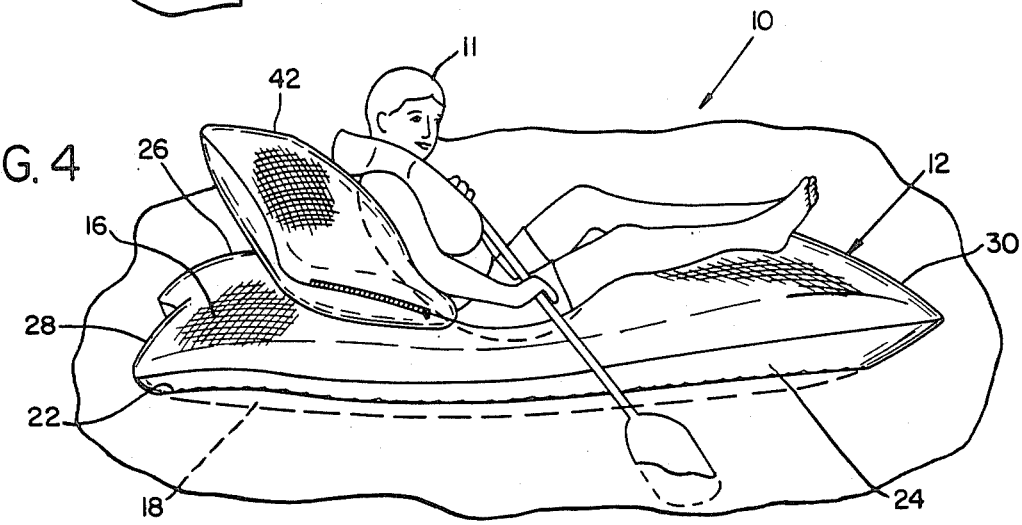

FLOAT MATTRESS

BACKGROUND OF THE INVENTION

This invention relates generally to float matresses and more particularly to a noninflatable, stable float mattress.

Float mattresses for floating a person in a pool, on a lake, or down a river have been in use for years. These matresses are basically of two types: inflatable air mattresses that obtain their buoyancy from air trapped within an outer bag and noninflatable mattresses that obtain their buoyancy from their material, such as cork, wood, or cellular polystyrene.

Both types of mattresses have advantages and drawbacks. Inflatable mattresses are light, portable, and compact but are easily damaged by punctures and must be continually repaired. Noninflatable mattresses, on the other hand, are more durable, but they are relatively heavy and cumbersome to transport.

A conventional mattress of either type, however, suffers from a more serious drawback. Because of its relatively large volume and low weight, a conventional mattress displaces litter water and floats with most of its volume above the waterline. With the mattress in its normal horizontal position, this causes a downward force acting on the mattress, its center of gravity, to be high relative to the upward opposing buyoyant force, its center of buoyancy. Such a relationship makes a mattress in water highly unstable and subject to capsizing by sudden shift of weight on the mattress or by rough water buffeting it about. As the mattress heels in response to the weight shift or rough water, its center of buoyancy shifts to a different position and the upward force strives to rotate the mattress about the center of gravity. So long as the metacenter of the mattress (the intersection of the normal center of buoyancy with the shifted center of buoyancy) is above the center of gravity, the mattress will right itself. But if the metacenter moves below the center of gravity, a situation likely to occur with the center of gravity high relative to the center of buoyancy, the mattress will capsize.

An example of a conventional, noninflatable matterss is shown in U.S. Pat. No. 4,275,473 to Poirier. The Poirier mattress comprises a plurality of rigid, parallel buoyant blocks fixed to an outer skin. The blocks are of a low density material with a large surface area, allowing the mattress to be easily upset by the shifting of a person's weight on the mattress or by rough water tipping the mattress. U.S. Pat. No. 3,380,088 to d'Adesky is of a similar design and suffers from the same drawback.

To achieve better stability, a float mattress should displace as little water as possible to raise its center of buoyancy and yet have a center of gravity as low as possible. U.S. Pat. No. 3,369,262 to Judd shows a flotation cushion with a relatively low center of gravity. The cushion absorbs water rather than displaces it. This absorption lowers the cushion's center of gravity, but the absorbed water is not easily removed and can capsize the cushion with a slight shift of a person's weight thereon. The saturated material within the cushion also makes the cushion heavy and therefore difficult to carry or dry.

SUMMARY OF THE INVENTION

It is an object, therefore, of the present invention to provide a float mattress having superior stability.

It is another object of the invention to provide a float mattress which displaces little water when placed in a body of water and yet has a center of gravity close to the waterline.

It is yet another object of the invention to provide a float mattress with these features, which is also lightweight and easily carried.

It is still another object of the invention to provide a float mattress with these features, which quickly dries upon removal from water.

To achieve these objects, a float mattress is disclosed that comprises porous, water resistant bag means and a granular, buoyant material contained within the bag means. The mattress is sized and shaped to support a person resting thereon while floating in water and stabilized therein by water freely passable through the bag means to displace air therein.

The bag means comprises a meshed fabric having openings smaller in size than the size of the granules of material. The meshed fabric contains the granules within the bag while allowing water and air to pass freely therethrough. The granular material may be of any type of buoyant material such as polystyrene pieces.

In one aspect of the invention, the bag means contains a closable storage pouch accessibly mounted therein. The top of the pouch has an egress opening which is flush with the top surface of the bag means. The body of the pouch extends into the granular material for storing refreshments or the like.

In another aspect of the invention, the float mattress includes a removable pillow of a construction corresponding to that of the mattress. The pillow is removably attached to the mattress and is used to support a person lying thereon in a reclined position.

The foregoing and other objects, features, and advantages of the invention will become more apparent from the following detailed description of a preferred embodiment which proceeds with reference to the accompanying drawings.

BRIEF DESCRIPTION OF THE DRAWINGS

FIG. 1 is a perspective view of a float mattress and accompanying pillow according to the invention.

FIG. 2 is a cross-sectional view on line 2—2 of FIG. 1.

FIG. 3 is a partial top plan view of the float mattress.

FIG. 4 is a pictorial view of the float mattress in the water with a person resting thereon.

FIG. 5 is a magnified view of the fabric of the float mattress.

DETAILED DESCRIPTION

A float mattress 10 according to the invention is shown in FIG. 1. It comprises a bag 12 of a meshed fabric in which a granular, buoyant material 14 (shown in FIG. 2) is contained. Mattress 10 is sized and shaped to support a person 11 resting thereon while it floats in water, as shown in FIG. 4, and stabilized therein by water freely passable therough the mesh fabric to displace air within bag 12, as illustrated in FIG. 2.

To form bag 12, an upper rectangular piece 16 of meshed fabric is sewn in a conventional manner to a matching lower piece 18 at a seam 22. See FIG. 2. Pieces 16, 18 are sewn together along both longitudinal edges 24, 26 and across a head lateral edge 28. At a base lateral edge 30, a zipper 32 is installed in a closable opening 33 between pieces 16, 18 to allow access into the interior of bag 12 for filling it with granular material 14. Zipper 32 is illustrative of only one means for allowing access to the interior of bag 12. Other suitable fastening means may be used as well.

As a convenience, bag 12 may include an inner storage pouch 34, as shown in FIGS. 1 and 2, for storing refreshments 36 or the like. The body of pouch 34 lies within bag 12 and is sewn flush at its opening 37 lengthwise to upper piece 16. Pouch 34 is located intermediate of lateral edges 28, 30 in a location easily accessible by a person 11 resting on mattress 10. Opening 37 is closable by a second zipper 38.

A removable pillow 42 of the same construction as mattress 10 is shown in FIGS. 1 and 4 resting on the mattress. It may be used with the mattress for supporting the person in a sitting position. The mesh fabric of bag 12 frictionally engages the corresponding fabric of pillow 42 to hold the pillow selectively in place on mattress 10.

The meshed fabric forming bag 12 and pillow 42 may be composed of any durable fabric such as burlap or a synthetic, preferably waterproof or capable of being waterproofed. Referring to FIG. 5, openings 44 within the meshed fabric should be smaller in size than the size of the granular material 14. The meshed fabric of bag 12 retains the granules of material 14 within the bag while allowing air and water to pass freely therethrough.

Although the meshed fabric generally is sufficient to retain granular material 14, an inner mesh liner 46 may be added as a further barrier, as shown in FIG. 3. Liner 46 has openings smaller in size than the granules of material 14 and is sized and shaped to fit snugly within bag 12 and around pouch 34. It further includes an opening 48 corresponding to opening 33 of bag 12 through which material 14 is placed.

The granular nature of material 14 gives matress 10 both longitudinal and lateral flexibility. This flexibility allows mattress 10 to fully support a person's body and to absorb buffeting from choppy waters. To provide this flexibility, material 14 comprises buoyant, waterproof material of a granular nature such as polystyrene pieces, commonly used as packing material. It is to be understood, however, that the term "granular material," as used herein, includes not only relatively small particles by also includes loose chunks of buoyant material of any size and shape compatible with the invention.

In operation, mattress 10 is floated in a body of water as shown in FIG. 4 and displaces water as shown in FIG. 2. The water passes freely through mesh openings 44 in the fabric of bag 12 until granular, buoyed material 14 displaces water equal in weight to mattress 10 and the person reclining thereon. Because the water in turn displaces air within mattress 10, the center of gravity of the mattress is closer to the waterline than if the volume of mattress were larger. The center of buoyancy, on the other hand, is not as deep in the water as in a conventional mattress because only the pieces of granular material 14 are buoyant, making for a smaller displaced volume in water. The metacenter of mattress 10 thus remains generally below its center of gravity in response to buffeting of the mattress by water or the shifting of a person's weight thereon, and the mattress rights itself.

Mattress 10 may also be easily removed and carried from the water. The water drains easily through mesh openings 44, allowing the mattress to lighten and dry quickly.

Having illustrated and described the principles of the invention in a preferred embodiment, it should be apparent to those skilled in the art that the invention can be modified in arrangement and detail without departing from such principles.

I claim all modifications coming within the spirit and scope of the following claims:

1. A float mattress comprising:

chunks of granular, buoyant material; and bag means comprising a meshed fabric having openings smaller in size than the size of the chunks of granular material for containing the chunks of granular material while allowing water and air to pass freely through the fabric, the bag means being substantially and loosely filled with the granular material to provide a mattress that is longitudinally and laterally flexible, the mattress being sized and shaped to support a person resting thereon while the mattress floats in water, the mattress being stabilized by water freely passable through the bag means to displace air within the bag means.

2. The float mattress of claim 1 in which the granular material includes a plurality of polystyrene pieces.

3. The float mattress of claim 1 in which the bag means contains a closable water permeable storage pouch accessibly mounted therein, the pouch having an egress opening therein, the opening being flush with the top surface of the bag means, the pouch extending into the granular material to allow the water to circulate through the storage pouch.

4. The float mattress of claim 1 further including an inner liner for containing the granular material, the inner liner further comprising a meshed fabric, the fabric having openings smaller in size than the size of the granules of material.

5. The float mattress of claim 1 further including a removable pillow comprising a bag and granular, buoyant material contained within the bag, the pillow being removably attached to the mattress.

6. A float mattress as in claim 1, further comprising a closable opening in the bag means for filling the bag means with granular material, the mattress thereby repairable by placing granular material therein to maintain the buoyancy of the mattress.

7. A float mattress, comprising:

granular, buoyant material;

a bag formed of a meshed fabric having openings smaller in size than the size of the granules of material for containing the granules while allowing water and air to pass through the fabric; and a closable water permeable storage pouch of meshed fabric mounted within the bag and having an accessible opening in the top surface of the bag, the pouch extending into the granular material to allow the water to circulate through the storage pouch to cool the contents of the pouch.

* * * * *